US007845589B2

(12) United States Patent
Pausch

(10) Patent No.: US 7,845,589 B2
(45) Date of Patent: Dec. 7, 2010

(54) AGITATING BALL MILL

(75) Inventor: Horst Pausch, Schwarzenbach/Saale (DE)

(73) Assignee: Netzsch-Feinmahltechnik GmbH (DE)

( * ) Notice: Subject to any disclaimer, the term of this patent is extended or adjusted under 35 U.S.C. 154(b) by 0 days.

(21) Appl. No.: 12/205,252

(22) Filed: Sep. 5, 2008

(65) Prior Publication Data

US 2009/0072060 A1 Mar. 19, 2009

(30) Foreign Application Priority Data

Sep. 13, 2007 (DE) ..... 10 2007 043 670

(51) Int. Cl.
*B02C 17/18* (2006.01)

(52) U.S. Cl. ..... 241/171; 241/172

(58) Field of Classification Search ..... 241/172, 241/171

See application file for complete search history.

(56) References Cited

U.S. PATENT DOCUMENTS 5,333,804 A * 8/1994 Liebert ..... 241/69

FOREIGN PATENT DOCUMENTS

| | | |
|---|---|---|
| DE | 1607591 | 10/1969 |
| EP | 1468739 A1 | 10/2004 |

* cited by examiner

*Primary Examiner*—Mark Rosenbaum
(74) *Attorney, Agent, or Firm*—St. Onge Steward Johnston & Reens LLC

(57) ABSTRACT

Agitating ball mill with a cylindrical grinding vessel comprising at least one grinding stock inlet and at least one grinding stock outlet wherein in the grinding vessel an agitating shaft connected with a drive is arranged which transmits a part of the drive energy to auxiliary grinding bodies which are loosely arranged in the grinding vessel and a separating device arranged in front of the grinding vessel outlet.

29 Claims, 10 Drawing Sheets

AGITATING BALL MILL

CROSS-REFERENCE TO RELATED APPLICATIONS

The present application claims priority from German patent application 10 2007 043 670.1, filed on Sep. 13, 2007, the content of which is incorporated herein by reference.

FIELD OF THE INVENTION

The invention relates to an agitating ball mill with a cylindrical grinding vessel having at least one grinding stock inlet and at least one grinding stock outlet, wherein in the grinding stock vessel an agitating shaft connected with a drive is arranged which transmits a part of the drive energy to auxiliary grinding bodies which are loosely arranged in the grinding vessel and a separating device arranged in front of the grinding stock outlet

BACKGROUND OF THE INVENTION

An agitating ball mill of this kind emerges from EP 1 468 739 A1. With this horizontally arranged agitating mill the grinding vessel is in connection with a grinding stock inlet and a grinding stock outlet. In the grinding vessel proper is located an agitating shaft which is in connection with a drive. The auxiliary grinding bodies filled into the grinding chamber are accelerated through agitating organs so that the grinding stock located between the auxiliary grinding bodies is ground or dispersed. The fineness of the product produced in this agitating ball mill is largely dependent on the size of the auxiliary grinding bodies employed. To separate the auxiliary grinding bodies from the grinding stock a separating device connected with the grinding stock outlet is provided at the end of the grinding vessel. This separating device comprises several arc-shaped conveying or wing elements which are arranged between two discs. The wing elements extend from the outer edge of the discs in the direction of their centre, wherein the elements partly end at different distances from the grinding stock outlet.

Because of the short distance which the auxiliary grinding bodies have to cover between the wing elements entry of auxiliary grinding bodies in the grinding outlet while the separating device is stationary cannot be prevented.

The object of the invention therefore consists in improving a separating device also for smallest grinding bodies so that entry of the auxiliary grinding bodies in the grinding stock outlet is prevented even during the start-up and run-down phase of the agitating ball mill. This object is solved with the characteristics of Claim 1.

Further embodiments according to the invention are mentioned in the characteristics of the subclaims.

SUMMARY OF THE INVENTION

Through the invention an agitating ball mill is thus created with a cylindrical grinding vessel having at least one grinding stock inlet and one grinding stock outlet, wherein the grinding vessel arranged horizontally as shown in the exemplary embodiment has an agitating shaft connected with a drive which transmits a part of the drive energy to the auxiliary grinding bodies. To separate the auxiliary grinding bodies from the grinding stock a separating device is employed which comprises at least one spiral.

With a preferred embodiment employed with smallest grinding bodies the separating device consists of two spirals.

A further preferential embodiment provides that the spirals are arranged with a constant distance to each other.

With smallest grinding bodies it can be advantageous to arrange the spirals with a varying distance to each other.

Another preferential embodiment of the invention is provided in order to achieve that the auxiliary grinding bodies among themselves are retained by friction. Here, the spiral directly extends with its radially inner end as far as the grinding stock outlet.

In order to increase the throughput in the agitating ball mill the grinding stock outlet can extend on both sides of the longitudinal centre of the spiral.

It has been shown that secure separation of the auxiliary grinding bodies from the grinding stock takes place when the spiral/s extend/s by a circumference of at least 360° about the longitudinal axis of the agitating shaft.

Depending on the throughput with which the mill is operated it can be advantageous if the width of the spiral/s amounts to at least one third of its diameter.

Since the spiral/s guarantee/s secure separation of the auxiliary grinding bodies from the grinding stock even with few revolutions it can be advantageous to rotate the spiral/s via an independent drive.

According to an advantageous arrangement in which the spiral/s is/are protected against excessive wear at the outer end the spiral sits between the agitating shaft surface and the longitudinal axis of the agitating shaft. Within a cage-like section of the agitating shaft which in this region comprises radial openings.

In order to promote the outflow of the auxiliary grinding bodies in this cage-like region the slot-shaped openings are inclined contrary to the direction of rotation of the agitating shaft.

Depending on the viscosity values which the product has it can be an advantage to configure the openings of the agitating shaft tangentially or asymmetrically to the longitudinal axis of the latter.

To loosen up the auxiliary grinding body package in the region of the outlet it can be an advantage to provide the agitating shaft with agitating elements in the region of the spiral/s which consist of agitating bars or cleats and which are staggered by at least 45° relative to one another.

With a further preferential embodiment the spiral/s contrary to the normal embodiment in which it/they consist/s of plate, consist/s of bars and webs individually spaced from one another. However, these bars and webs need not be connected with one another in a contacting manner.

It is further preferred that the diameter of the spiral/s comprises at least 30% of the grinding chamber diameter.

In a further embodiment version the diameter of the spiral/s is at least 30% of the diameter of the hollow space in the agitating shaft.

If the separating device is employed with a drive arranged independently from the agitating shaft it can be an advantage if the spirals are inserted between two holohedral end faces.

To improve the backflow of the auxiliary grinding bodies it can be an advantage if the end faces located laterally on the spirals comprise openings through which the auxiliary grinding bodies can flow back into the grinding chamber.

To influence the flow direction in the region of the outlet it will be an advantage if a laterally arranged displacement body is inserted in the spiral/s.

BRIEF DESCRIPTION OF THE DRAWINGS

The invention is explained in more detail merely exemplarily in the following by means of exemplary embodiments making reference to the drawings. It shows.

DETAILED DESCRIPTION OF THE INVENTION

Figure 1:
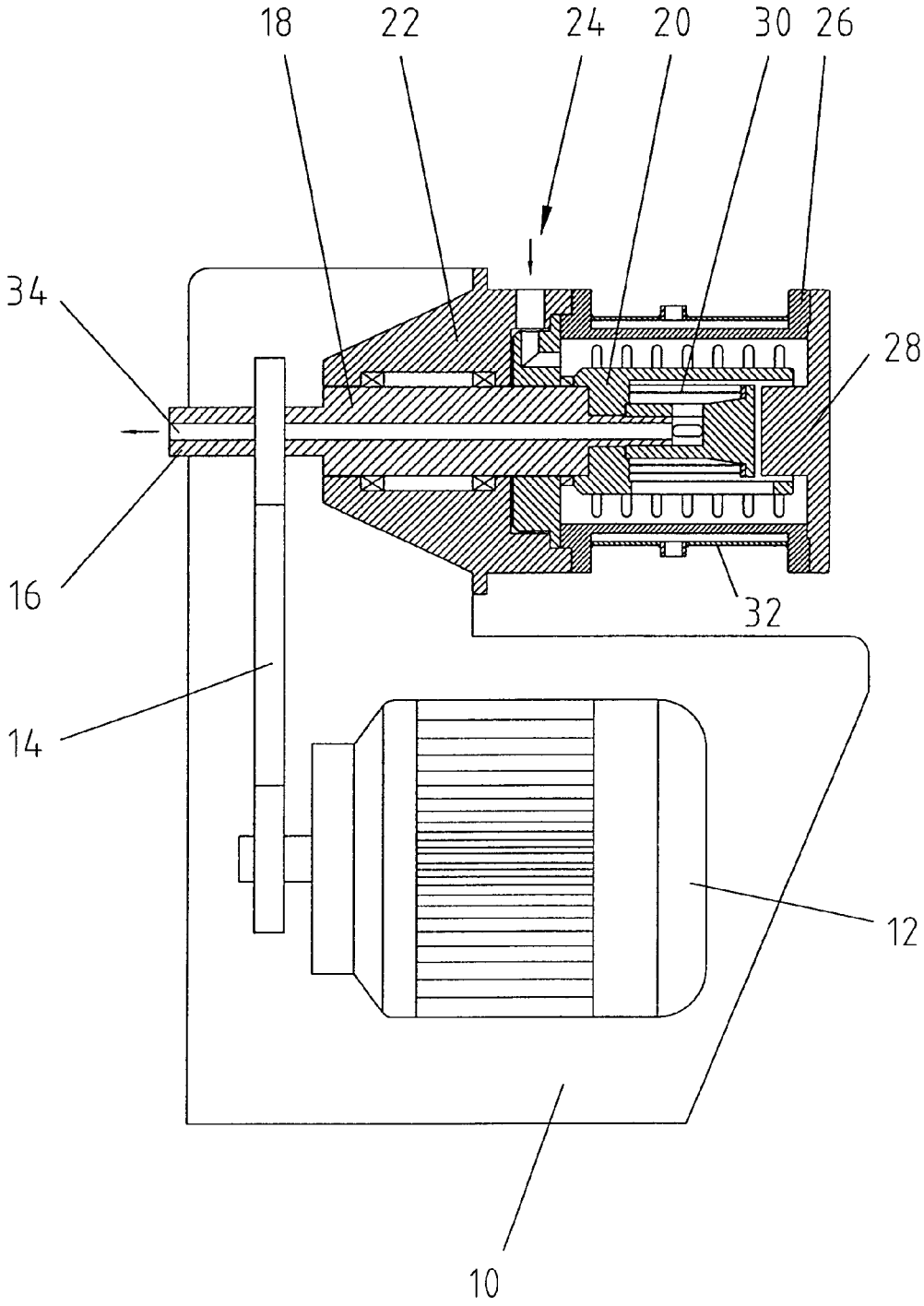
FIG. 1 is schematic lateral view of an agitating ball mill
Figures 2, 3, 4, 5, 6:
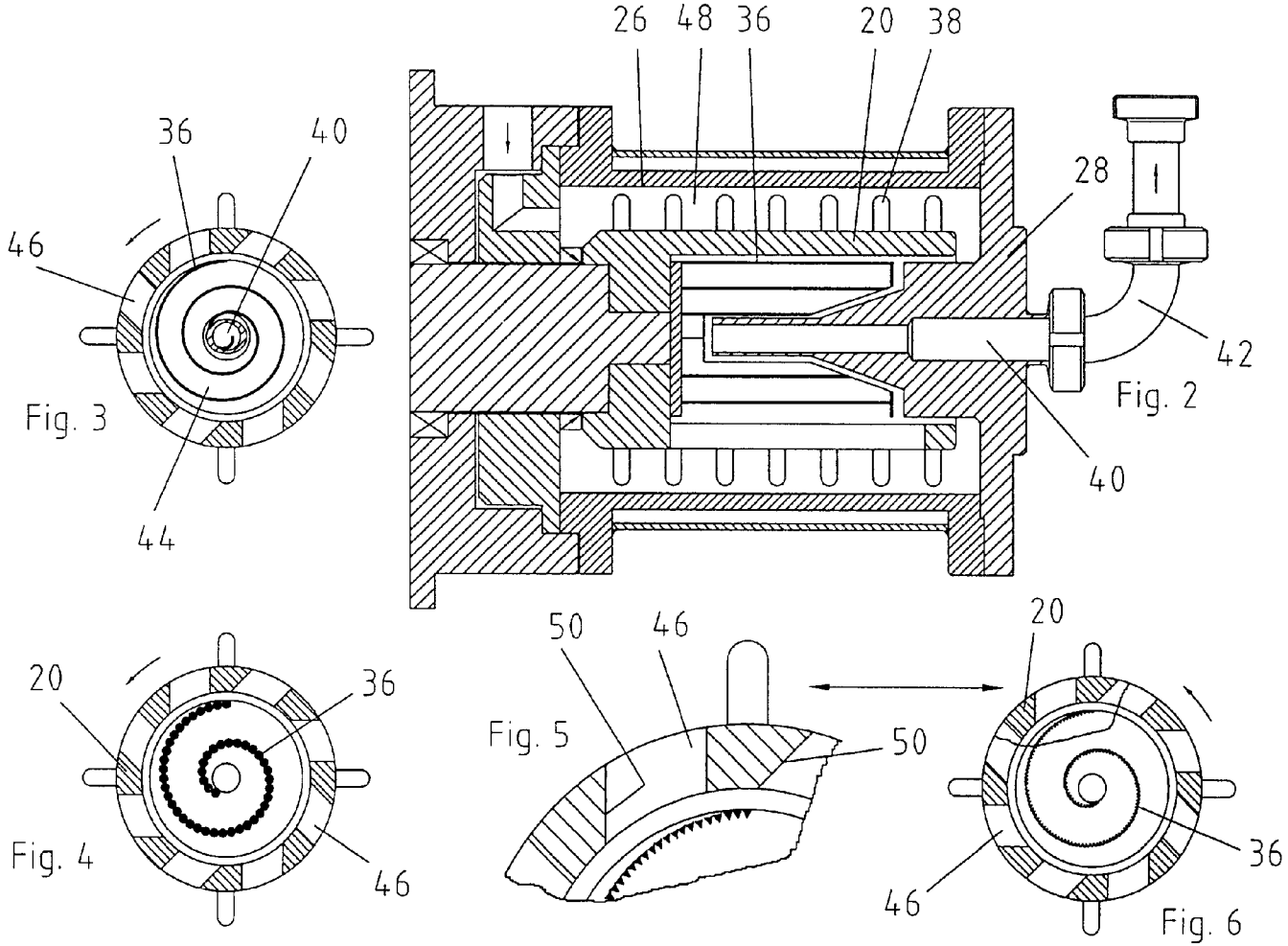
FIG. 2 is schematic lateral view of the ball mill
FIG. 3 is vertical section to a spiral arrangement
FIG. 4 is vertical section through a screw guideway
FIG. 5 is part view of the agitating shaft with spiral section
FIG. 6 is vertical section of the agitating shaft

The agitating ball mill according to the invention consists of a housing 10 in which a drive 12 in form of an electric motor is seated. The drive is in connection with a drive shaft 16 by means of a drive belt 14. This drive shaft merges with the bearing shaft 18 which in turn is connected with the agitating shaft 20. On the upper side of the bearing housing 22 is located the grinding stock inlet 24. The grinding chamber 48 is limited by the grinding vessel 26 surrounding the agitating shaft 20 and the grinding vessel base 28. The separating device 30, with which the auxiliary grinding bodies 54 are separated from the grinding stock, is seated within the agitating shaft 20. To cool or heat the grinding vessel the latter is surrounded in a double-walled manner by a jacket 32 capable of being cooled and heated. The grinding stock leaves the grinding vessel via a central grinding stock outlet which leads from the agitating shaft via the bearing shaft as far as the drive shaft. FIG. 2 shows the arrangement of a spiral 36 within the agitating shaft 20 in whose surface agitating bars 38 are inserted. Here, the grinding stock flows out centrally from the grinding vessel 26 via a line 40 which merges into a pipeline 42.

FIG. 3 discloses the embodiment of a spiral for example employed for separating the auxiliary grinding bodies from the grinding stock. This spiral 36 in this case extends over 720°. The grinding stock flowing into the spiral reaches the grinding stock outlet through the pipeline 40. In order to bring about relief of the separating device the auxiliary grinding bodies are transported back into the grinding chamber 48 via passages 46 in the agitating shaft even before entering the screw passageway 44.

Exemplary embodiments of the arrangement of the spiral can be seen in FIGS. 4 and 5 where the spirals 36 each extend about 360°. In FIG. 4 the spiral consists of bars, in FIG. 6 of triangular profiles. Through these inner surfaces of the spirals that can be described as rough in the widest sense the effect of retention by friction which occurs during the stationary state of the agitating shaft is supported. To increase this retention-by-friction effect the embodiment of the spiral in FIGS. 4 and 6 can be increased by extending the spiral.

Figure 7:
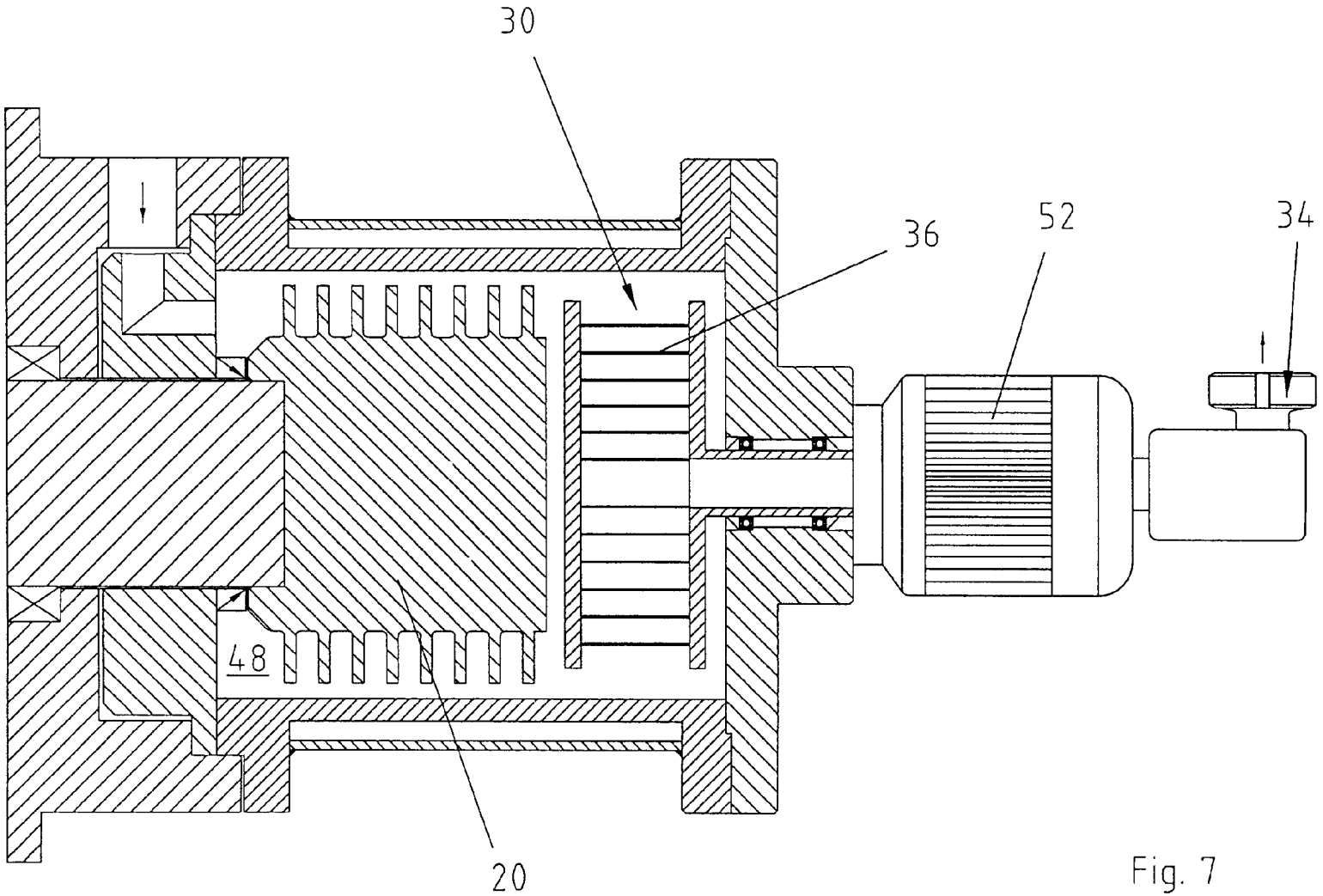
FIG. 7 is schematic lateral view of an agitating ball mill

FIG. 5 explains the embodiment of the passages 46 whose lateral surfaces 50 are directed tangentially to the centre axis of the agitating shaft. FIG. 7 shows a separating device 30 which comprises one or several spirals 36. Depending on how long the distance of the individual auxiliary grinding bodies in the spiral is, the fewer revolutions will the separate drive 52 have to complete in order to bring about entering of the auxiliary grinding bodies in the grinding stock outlet.

Figure 8:
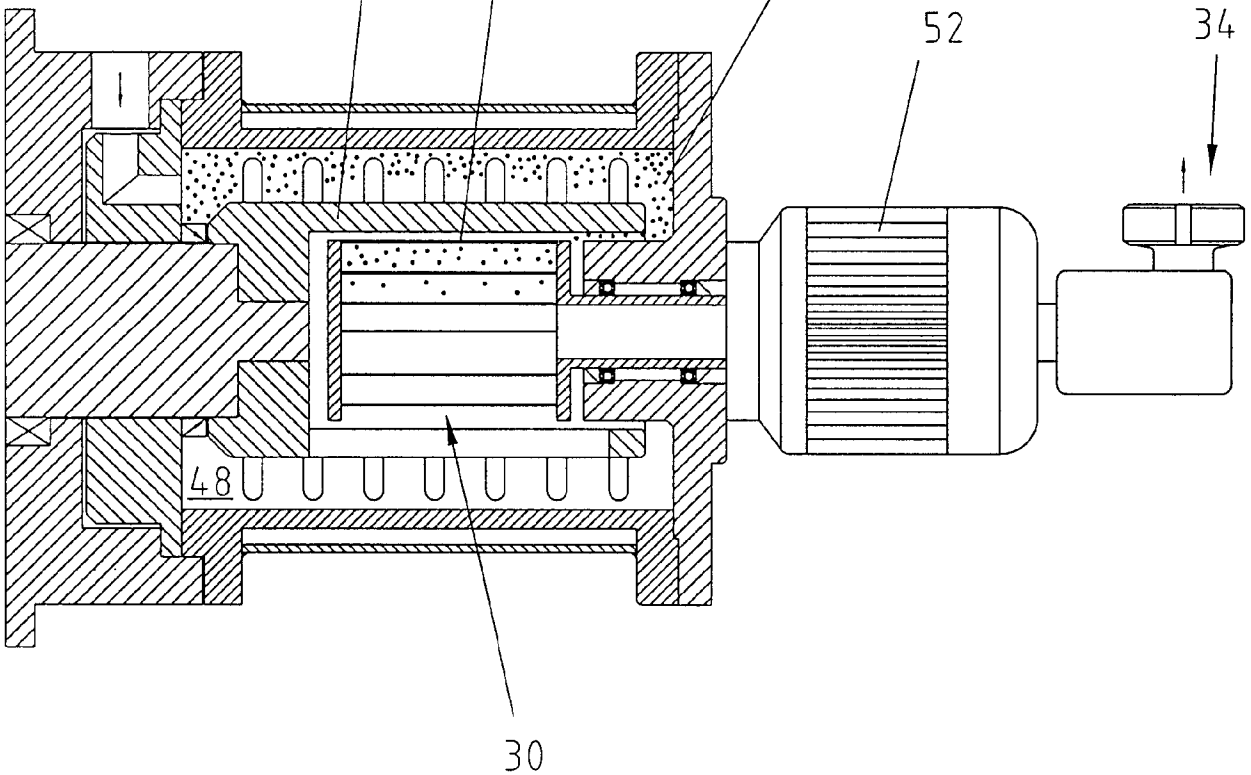
FIG. 8 is schematic lateral view of an agitating ball mill

In FIG. 8 the separating device 30 is likewise rotated with a drive 52 separated from the agitating shaft 20. In addition, the separating device 30 in this case is located in a hollow space within the agitating shaft 20 as a result of which it is substantially protected against excessive wear through the auxiliary grinding bodies 54 activated by the agitating shaft 20. Purely schematically it is also shown in this exemplary embodiment how the auxiliary grinding body concentration decreases from the grinding chamber 48 in the direction of the grinding stock outlet 34.

Figure 9:
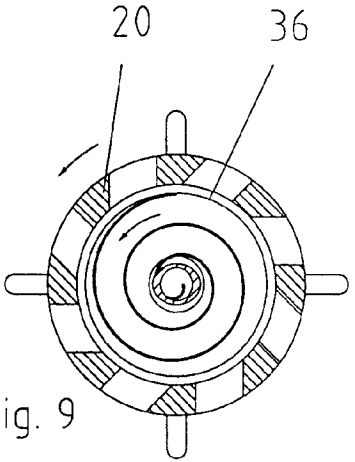
FIG. 9 is vertical section through an agitating shaft
Figure 10:
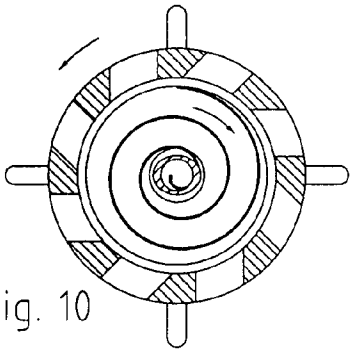
FIG. 10 is vertical section through an agitating shaft

In FIGS. 9 and 10 it can be seen that the separating device operates with a right-hand rotating as well as a left-hand rotating spiral. In the final analysis it is not critical that the spiral rotates in the direction of rotation opposite to that of the agitating shaft. The function of the spiral is independent of the direction of rotation of the agitating shaft.

Figure 11:
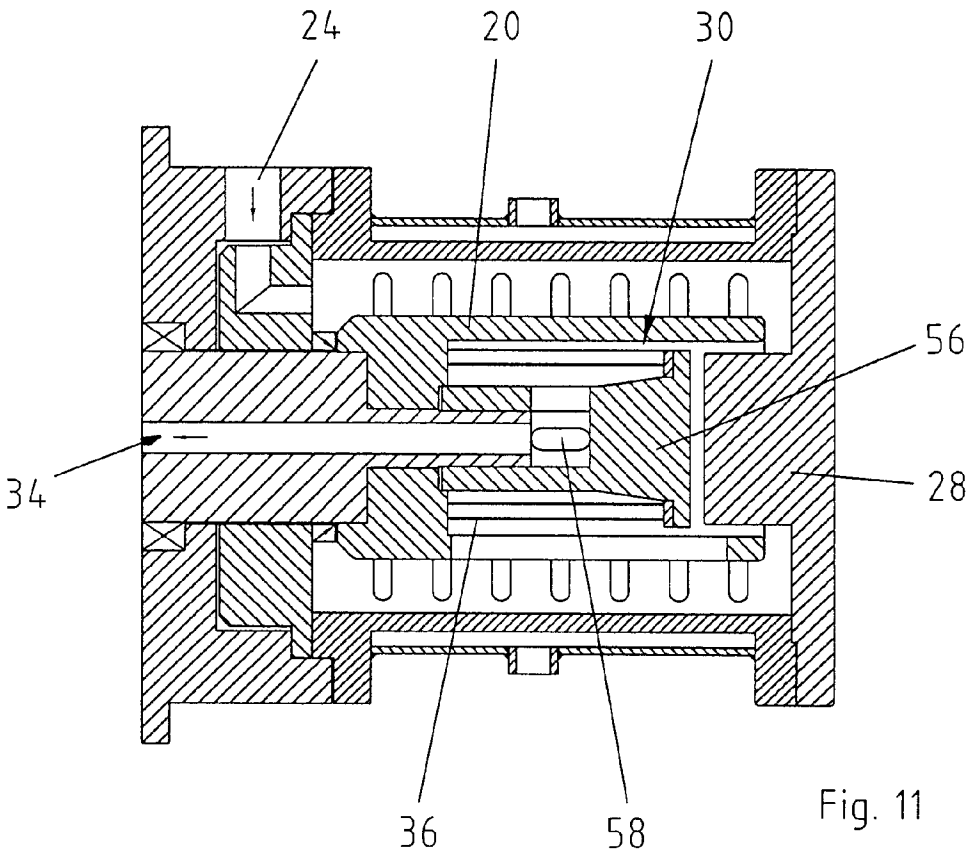
FIG. 11 is schematic lateral view of a grinding vessel
Figure 12:
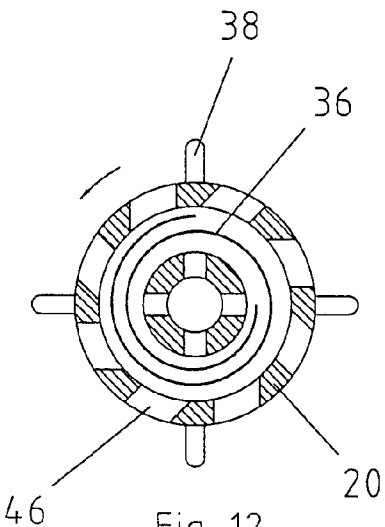
FIG. 12 is vertical section of an agitating shaft

In the case of the agitating ball mill shown in FIG. 11 the separating device 30 rotates synchronously with the agitating shaft 20. The spiral 36 of the separating device rests against the agitating shaft with its left side and with the right side is clamped to the agitating shaft with a clamping element 56. Centrally in the longitudinal centre of the spiral in the region of the longitudinal axis of the agitating shaft 20 is located the inlet 58 of the grinding stock outlet 34. FIG. 12 illustrates in this case the length of the spiral 36 which in this case comprises a range of 630°.

Figure 14:
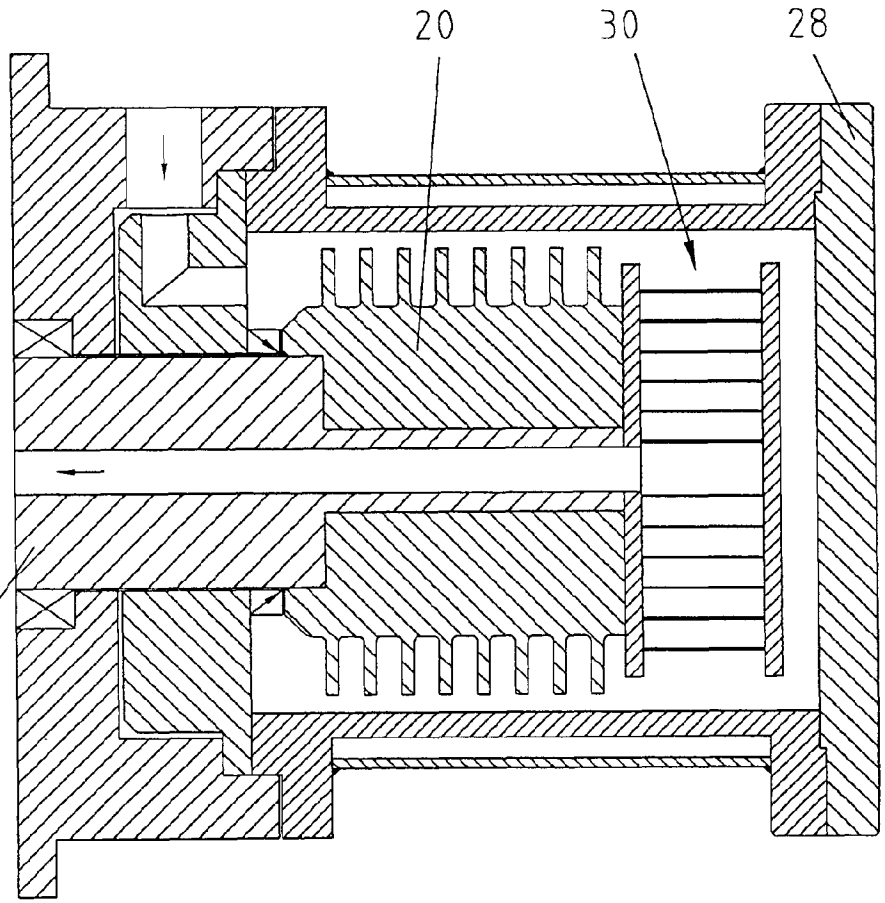
FIG. 14 is schematic lateral view of a grinding vessel
Figure 13:
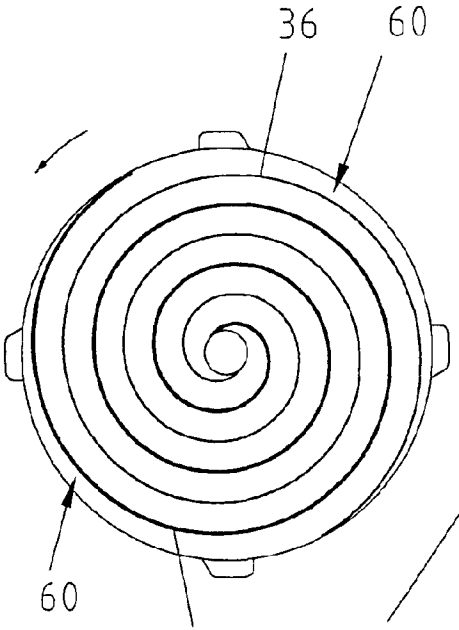
FIG. 13 is vertical section of a separating device
Figure 15:
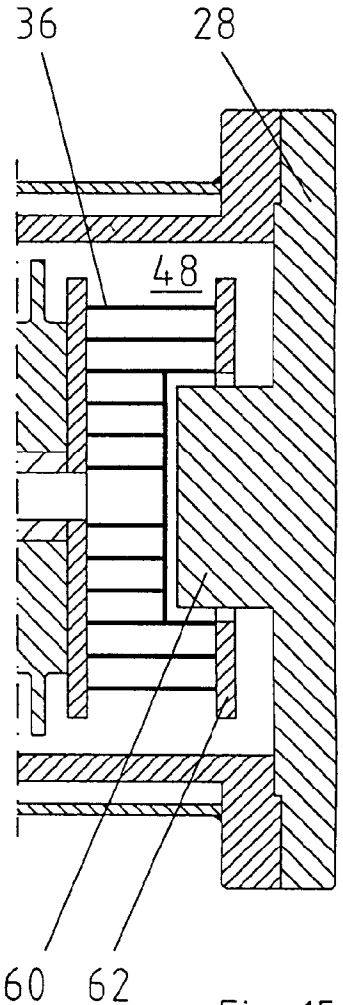
FIG. 15 is part view of a separating device

The embodiment of the separating device according to FIGS. 13, 14 and 15 is more preferably geared up for high-viscosity substances. Since the adhesion forces between the product and the auxiliary grinding bodies are very great in high-viscosity substances, a longer distance for separating the auxiliary grinding bodies is required, which is why two spirals 36 are provided in FIG. 13. Here, the outer surfaces of the spirals each act like deflectors as far as the start of the further screw. This means that these surfaces 60 generate a pulsating effect in the direction of the grinding chamber and thus bring about a deflection of the auxiliary grinding bodies in the direction of the grinding chamber even at the circumference of the separating device. In addition to this, the auxiliary grinding bodies during the course of the spiral passageways which extend over 1080° are continuously forced to return into the grinding chamber through the friction forces on the spiral walls and the inverse conveying direction.

The FIG. 14 shows the use of the spirals 36 described in FIG. 13. The separating device here is directly located on the end face of the cantilever-mounted agitating shaft 20. The product flows out centrally via the agitating shaft 20 and bearing shaft 18.

In FIG. 15 the grinding vessel base 28 comprises a shoulder 60. In this region the spiral 36 is open in the direction of the shoulder so that the auxiliary grinding bodies can flow back into the grinding chamber 48 via short distances. The outer region of the spiral 36 is limited by a ring 62.

Figure 17:
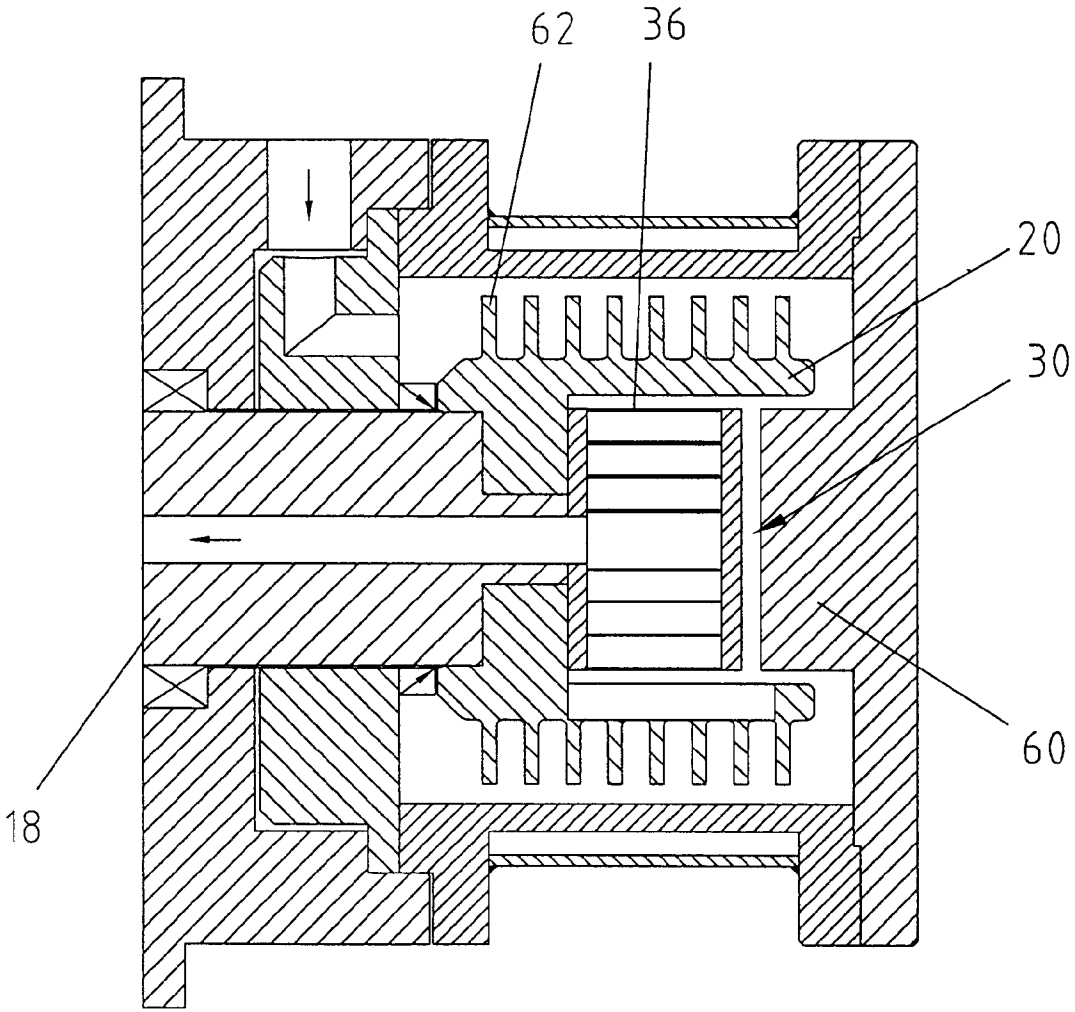
FIG. 17 is schematic lateral view of a grinding vessel
Figure 16:
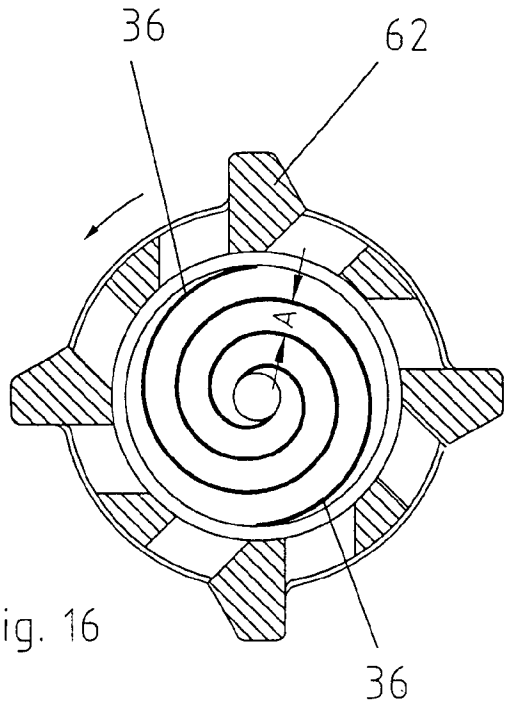
FIG. 16 is vertical section of an agitating shaft
Figure 21:
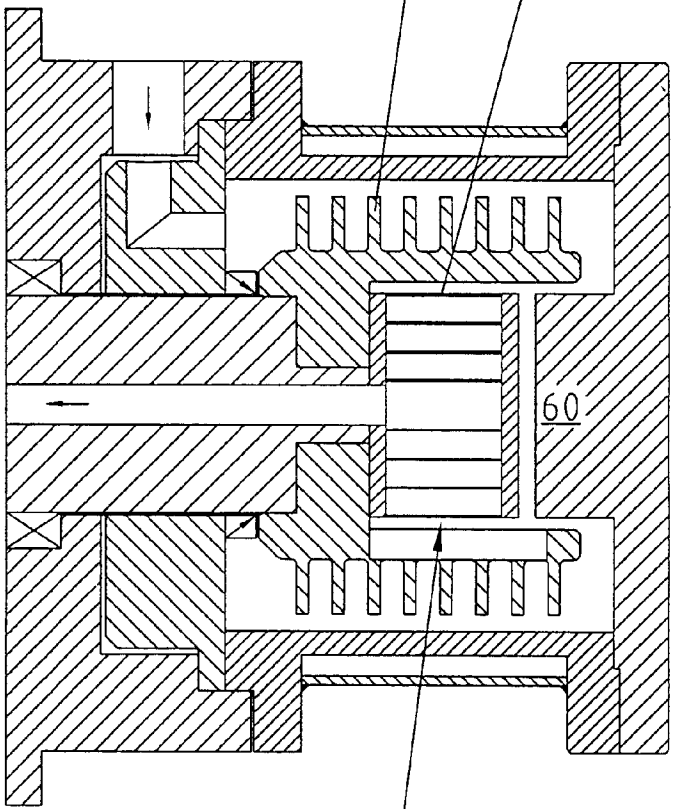
FIG. 21 is schematic lateral view of a grinding vessel

FIGS. 16 and 17 show separating devices with two spirals each of which extends over a range of 500° and 560°. The two spirals have screw passageways with always constant wall distance A. The separating device 30 rotates jointly with the agitating shaft 20, wherein the product outlet is effected through the agitating shaft 20 and bearing shaft 18. To avoid dead zones in which no grinding stock grinding body flow is generated, a shoulder 60 is embodied in the separating device which is used for flow formation. The agitating shaft in this exemplary embodiment comprises no grinding pins 31 but cleats 62.

Figure 18:
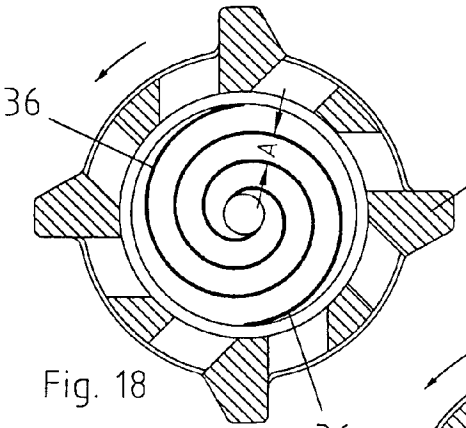
FIG. 18 is vertical section of an agitating shaft
Figure 19:
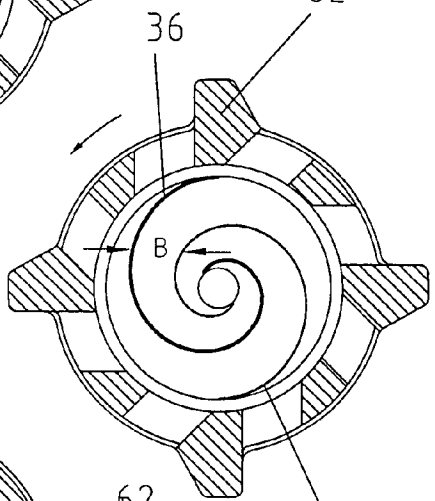
FIG. 19 is vertical section of an agitating shaft
Figure 20:
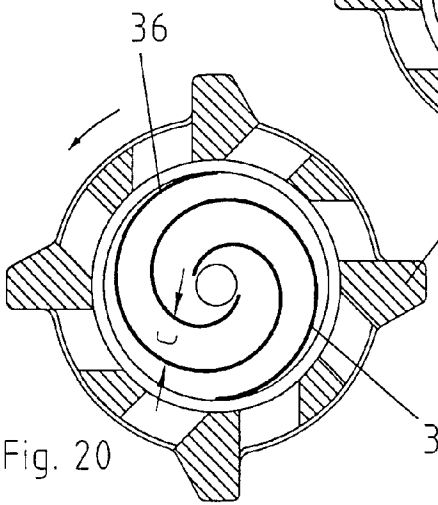
FIG. 20 is vertical section of an agitating shaft

FIGS. 18, 19, 20 and 21 demonstrate the position and the embodiment of separating devices with spirals whose distance is embodied constant as in FIG. 18, reducing as in FIG. 19 and expanding as in FIG. 20. FIG. 18 here corresponds to FIG. 16 where the distance A remains constant over the entire arrangement of the two spirals 36. In FIG. 19 the spirals 36 are arranged so that the distance B from the grinding chamber to the outlet is reduced. This version is particularly used when low-viscosity material is employed and it must be expected that the agitating ball mill will be briefly put out of operation. Through the reducing distance between the two spirals the retention-by-friction effect between the spiral walls and the auxiliary grinding bodies is reinforced. Through the arrangement of the two spirals according to FIG. 20 it is possible to achieve a faster outflow of the product following the separation from the auxiliary grinding bodies. The shown geometry of the two spirals 36 shows that the distance C increases in the direction from the grinding chamber to the grinding stock outlet.

Figure 23:
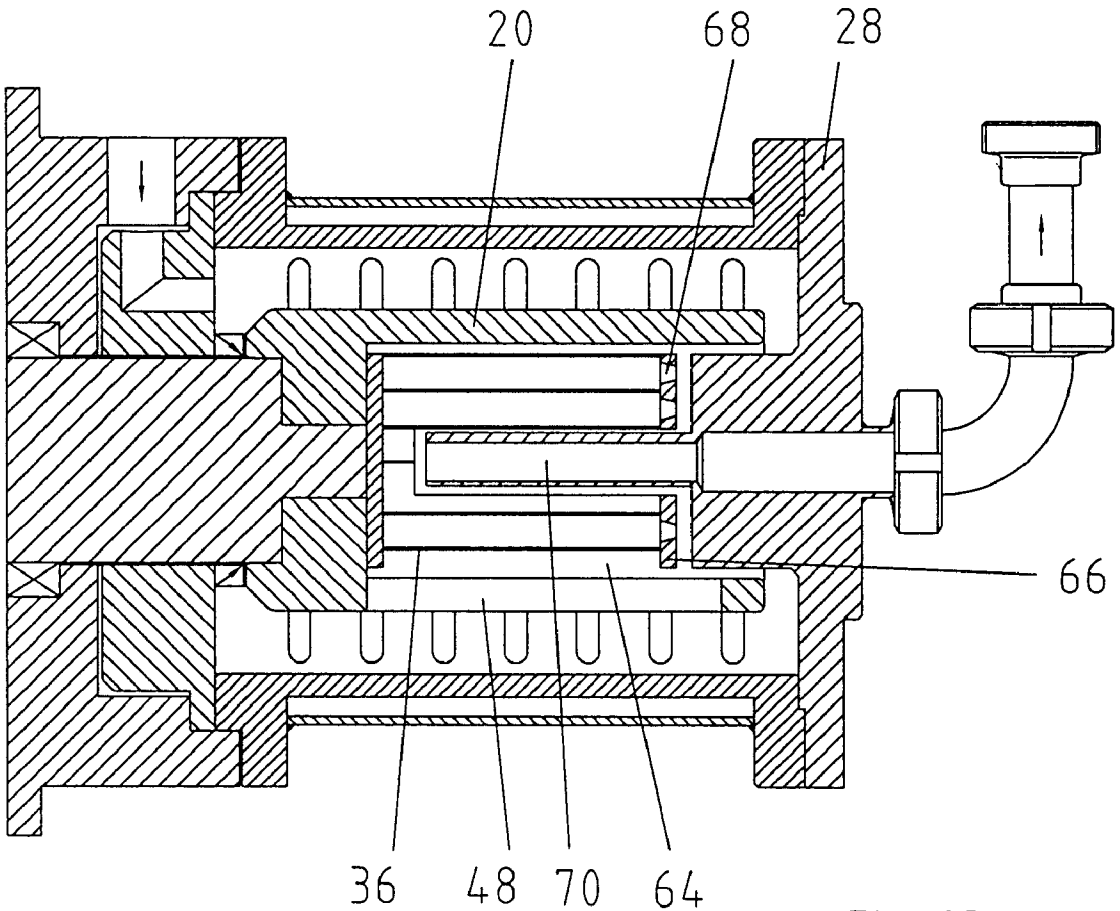
FIG. 23 is schematic lateral view of a grinding vessel
Figure 22:
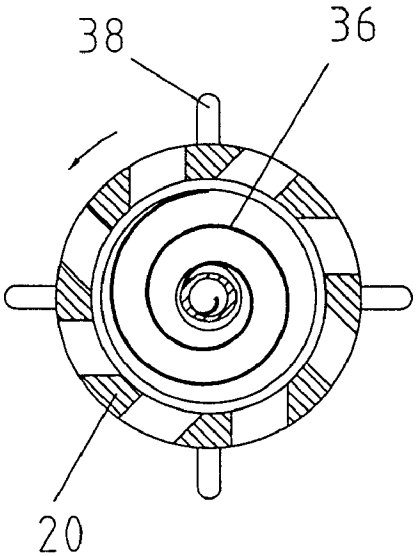
FIG. 22 is vertical section of an agitating shaft

A further possibility of transporting auxiliary grinding bodies from the region of the separating device laterally from the spiral passageways back into the grinding chamber is shown in FIG. 23. Here the separating device 30 is seated within a hollow space 64 which is open on one side within the agitating shaft. The spiral 36 is held by the agitating shaft 20. At the face end of the spiral 36 facing the grinding vessel base 28 is located a ring 66 which connects each spiral passageway with the hollow space 64 thus offering the grinding auxiliary bodies the possibility of flowing from the spiral via the hollow space back into the grinding chamber 48. The ring has a slot 68 through which the auxiliary grinding bodies can flow back into the grinding chamber via the hollow space 64. The processed grinding stock leaves the grinding chamber from the central region within the spiral/s 36 via an immersion pipe 70. As is evident from FIG. 22 this separating device comprises only one spiral 36.

What is claimed is:

1. An agitating ball mill with a cylindrical grinding vessel comprising at least one grinding stock inlet and at least one grinding stock outlet wherein in the grinding vessel an agitating shaft connected with a drive is arranged which transmits a part of the drive energy to auxiliary grinding bodies which are loosely arranged in the grinding vessel and a separating device arranged in front of the grinding stock outlet, wherein the separating device consists of at least one spiral radiating from a central point outwards.

2. The agitating ball mill according to claim 1, wherein the separating device consists of at least two spirals.

3. The agitating ball mill according to claim 2, wherein the radially outer ends of at least two spirals are offset relative to one another by at least 90° each.

4. The agitating ball mill according to claim 2, wherein the at least two spirals are arranged with a constant distance to each other.

5. The agitating ball mill according to claim 2, wherein the at least two spirals are arranged with a varying distance to each other.

6. The agitating ball mill according to claim 1, wherein a radial inner end of the at least one spiral ends directly at the grinding stock outlet.

7. The agitating ball mill according to claim 1, wherein the grinding stock outlet extends on both sides from a longitudinal centre of the at least one spiral.

8. The agitating ball mill according to claim 1, wherein the at least one spiral extends about a circumference of at least 180°.

9. The agitating ball mill according to claim 8, wherein the at least one spiral extends about a circumference of at least 360°.

10. The agitating ball mill according to claim 1, wherein a width of the at least one spiral amounts to at least ⅓ of its diameter.

11. The agitating ball mill according to claim 1, wherein the at least one spiral is rotated by a drive independent of the agitating shaft.

12. The agitating ball mill according to claim 1, wherein the separating device consisting of at least one spiral is arranged between the agitating shaft surface and the longitudinal axis of the agitating shaft.

13. The agitating ball mill according to claim 12, wherein the agitating shaft in the region of the at least one spiral is embodied hollow and has openings.

14. The agitating ball mill according to claim 13, wherein the passages are embodied as parallel slots whose inclination is contrary to the direction of rotation of the agitating shaft.

15. The agitating ball mill according to claim 14, wherein the passages in the agitating shaft are oriented tangentially or asymmetrically to the longitudinal axis of said agitating shaft.

16. The agitating ball mill according to claim 12, wherein the agitating shaft in the region of the at least one spiral comprises agitating bars.

17. The agitating ball mill according to claim 16, wherein the agitating bars or cleats are offset relative to one another by at least 45°.

18. The agitating ball mill according to claim 12, wherein the at least one spiral is connected with the agitating shaft.

19. The agitating ball mill according to claim 1, wherein the grinding stock outlet is realised through the agitating shaft.

20. The agitating ball mill according to claim 1, wherein the grinding stock outlet is realised through a static immersion pipe arranged in the centre of the at least one spiral.

21. The agitating ball mill according to claim 1, wherein the at least one spiral consists of individual bars spaced from one another.

22. The agitating ball mill according to claim 1, wherein a diameter of the at least one spiral amounts to at least 30% of the grinding chamber diameter.

23. The agitating ball mill according to claim 1, wherein a diameter of the at least one spiral amounts to at least 30% of the diameter of the hollow space in the agitating ball mill.

24. The agitating ball mill according to claim 1, wherein the at least one spiral is inserted laterally between two holohedral end faces.

25. The agitating ball mill according to claim 1, wherein the at least one spiral comprise end face provided with openings on one or both sides.

26. The agitating ball mill according to claim 1, wherein a displacement body laterally engages in the at least one spiral.

27. The agitating ball mill according to claim 1, wherein the grinding vessel is arranged horizontally.

28. The agitating ball mill according to claim 1, wherein at least one lateral bracket on the at least one spiral is provided with slots at one or several points at a radial distance to the grinding stock outlet.

29. The agitating ball mill according to claim 1, wherein at least one of the inner or outer surfaces of the at least one spiral comprises a structured surface structure.

* * * * *